United States Patent [19]

Cameron

[11] Patent Number: 4,640,179

[45] Date of Patent: Feb. 3, 1987

[54] COMPOSITE METALLIC CORE LINE

[76] Inventor: Robert W. Cameron, 7725 115th Pl. NE., Kirkland, Wash. 98003

[21] Appl. No.: 778,365

[22] Filed: Sep. 20, 1985

Related U.S. Application Data

[63] Continuation-in-part of Ser. No. 624,222, Jun. 25, 1984, abandoned.

[51] Int. Cl.[4] ..... D04C 1/12; D07B 1/16

[52] U.S. Cl. ..... 87/6; 57/210; 57/232; 87/1; 87/8

[58] Field of Search ..... 87/5-8; 87/1; 57/211, 217, 221, 222, 210, 232

[56] References Cited

U.S. PATENT DOCUMENTS

| | | | |
|---|---|---|---|
| 974,843 | 11/1910 | Tolman et al. | 87/1 |
| 2,257,648 | 9/1941 | Pierce | 87/1 |
| 2,737,075 | 3/1956 | Poirier | 87/6 |
| 4,034,547 | 7/1977 | Loos | 57/211 |
| 4,195,549 | 4/1980 | Schuster et al. | 87/1 |
| 4,299,884 | 11/1981 | Payen | 428/377 |
| 4,321,854 | 3/1982 | Foote et al. | 87/6 |

OTHER PUBLICATIONS

Loos & Co Cable Assemblies catalog #81A, Loos & Company Inc.

*Primary Examiner*—John Petrakes
*Attorney, Agent, or Firm*—Seed and Berry

[57] ABSTRACT

A multiple-layer braided line having a high tensile strength composite steel core in which the innermost braided fibrous sheath layer is nylon, securely bonded to the composite steel core. An outer braided fibrous sheath is polyester formed over the inner sheath. The core is selected with a tensile strength over the desired rate load-carrying ability of the line, but less than that of the overall tensile strength of the inner and outer sheaths. The line is lightweight and has a high tensile strength and improved resistance to severing, melting and burning results, suitable for use by mountaineers, firemen and rescue workers. The line substantially eliminates backlash.

12 Claims, 3 Drawing Figures

COMPOSITE METALLIC CORE LINE

CROSS-REFERENCE TO RELATED APPLICATION

This application is a continuation-in-part of U.S. patent application Ser. No. 624,222, filed June 25, 1984, now abandoned.

TECHNICAL FIELD

This invention relates to mountaineering and survival gear, and more particularly, to lightweight lines widely used by mountaineers, rescue workers and firemen, and in certain military and marine applications. The line of this invention is resistant to severing, sunlight, chemicals, shock, and also to destruction by fire or high temperatures, such as may be encountered in its use by firemen.

BACKGROUND ART

Heretofore, multiple-layered mountaineering and survival-type lines have been known. However, their use in extremely hazardous situations has been limited by their inherent nature. For example, in the event of fire or high temperature applications, the nylon and other synthetic materials used in manufacturing such lines melt or burn, or are so severely weakened that the line becomes unusable. All too frequently, it has been determined that firemen will choose more dangerous escape routes from the upper floors of structures over a less dangerous route which requires use of a line when a flame is close by for fear the line will burn or melt, causing their fall. The choice sometimes results in the death of a trapped fireman.

Lines subjected to duty in which they come into contact with a rock outcropping or other sharp object may be severed or partially severed since the synthetic materials utilized in their construction are not highly resistant to chafing and severing. In addition, if the line is partially severed, the multiple-layer construction allows the individual layers frequently to slip along the core or relative to another, making it difficult to grasp.

Exposure to chemicals can also degrade the line and cause its failure. For safety, line is frequently discarded and not used again as a precaution if subjected to any chemicals or even if chemicals are found on the ground in the area where the line has been on the ground.

Exposure of a nylon line to ultraviolet light will break down the nylon fiber and degrade the line. For safety, nylon line is discarded after being exposed to sunlight for a period of time. The same disposal procedure is sometimes followed when a line is subjected to extreme shock.

In all of these situations, ont only is complete failure of the line possible during use, but the line when discarded may still possess sufficient strength to function adequately. Since it is impossible to determine this for a fact, and since, should the line fail, the user could be seriously injured or killed, it is general practice to incur the expense of premature disposal of the line.

Another disadvantage of conventional multiple-layer line, particularly when used for rescue, is its elasticity. During a rescue, there is frequently but one opportunity afforded to make the rescue. By using a conventional line which experiences a certain degree of stretch and bounce when under load, the timing and precision of the rescue can be adversely affected, resulting in an unsuccessful rescue attempt.

While use of a metal cable will avoid the fire/heat and severing problems, avoid the problem of exposure to chemicals, ultraviolet light and shock, and avoid the elasticity problem, cables are difficult to grasp due to their small diameter and difficult to tie and otherwise manipulate due to their unwieldly nature. Generally, a knot cannot be tied in cable which will cinch tightly enough to hold and be safe. It is not possible to increase the diameter of the cable to facilitate grasping of the cable due to weight and other considerations, and doing so would make tying of knots even more difficult. Another problem with metal cable is that its outer surface is sometimes too slippery to be securely grasped, making for an unsafe condition, and is sometimes too abrasive to be safely handled, depending on the type and condition of the cable.

Another serious disadvantage when using a metal cable, should the cable snap under load, is that the inherent whip or backlash causes the severed and loose ends of the cable to be propelled, sometimes at great speed, toward the source of the load. The ends generally flail about as they fly through the air and can cause great injury and even death to the cable user and bystanders. Of course, if the severing results in a fall of the user, injury or death could also result. While described herein for wire cables, the backlash problem exists for synthetic ropes also.

It is an object of this invention to provide a lightweight, manipulatable, easy-to-grasp line of relatively high strength for use such as by mountaineers, firemen and others. The line should be a static line without significant stretch. Exposure to fire/heat, sharp objects, chemicals, sunlight or shock should not produce failure of the line or require its premature disposal. If the load-carrying limits of the line are exceeded, it should not fail completely and dangerous backlash should not occur. Even if the line is severed completely, backlash should be minimized. It is another object of this invention to provide a line having a plurality of braided or woven layers which are resistant to axial movement along a core and each other.

DISCLOSURE OF THE INVENTION

The present invention resides in a composite line having a core of heat-resistant, substantially in elastic metallic cable, and at least one fiber sheath thereabout. A preferred embodiment uses an inner fiber sheath braided tightly about the core, and an outer fiber sheath braided tightly about the inner sheath. The core has a tensile strength sufficient to separately support the desired rate at load. The inner and outer sheaths have a combined tensile strength substantially exceeding the tensile strength of the core, and contain the core therewithin upon breakage of the core under extreme loading to substantially eliminate backlash. The core has a weight sufficient to minimize backlash of the inner and outer sheaths upon subsequent breakage thereof. As such, a substantially static line is provided which will support the rated load even if the inner and outer sheaths are melted or severed by fire, heat or sharp objects.

In the presently preferred embodiment of the invention, the inner sheath is nylon and the outer sheath is polyester. The outer polyester sheath shields the inner nylon sheath from exposure to sunlight or abrasion, thus protecting the nylon from both and prolonging the life and increasing the durability of the line. The inner sheath is securely adhered to the cord to prevent its axial movement therealong, and the inner and outer sheaths are adhered together. The core may include high tensile strength polymer fibers, or have an elastic memory causing the line to assume a coiled configuration whenever tension on the line is relieved.

Other features and advantages of the invention will become apparent from the following detailed description, taken in conjunction with the accompanying drawings.

BEST MODE FOR CARRYING OUT THE INVENTION

Referring particularly to the drawings wherein line numerals indicate like parts, there is shown a survival or mountaineering line 10 having significantly improved resistance to destruction by heat and fire, sharp objects, chemicals, sunlight and shock. The line 10 is constructed with a central core 12 made of a high tensile strength, heat-and cut-resistant material, such as a twisted cable of stainless steel or other strand-formed metallic cable. For certain applications, the core may be woven or braided from metal strands in a manner to provide a non-rotating cable as the core, and hence a non-rotating line.

A preferred material for the core 12 is itself a multiple-layer stranded cable having an interior core of a polyarimid of aromatic tetracarboxylic acid dianhydride sold under the trademark KEVLAR® and more specifically defined in U.S. Pat. No. 3,179,634. The cable is manufactured under U.S. Pat. No. 4,034,547 and sold by Loss & Co., Inc., under the trademarks K-KORE® and K-FLEX®.

Figure 3:
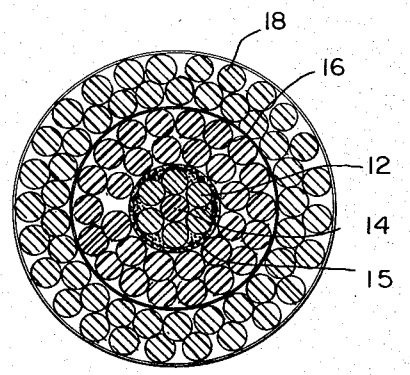
FIG. 3 is a cross-sectional view taken along lines 3—3 of FIG. 2.
Figure 1:
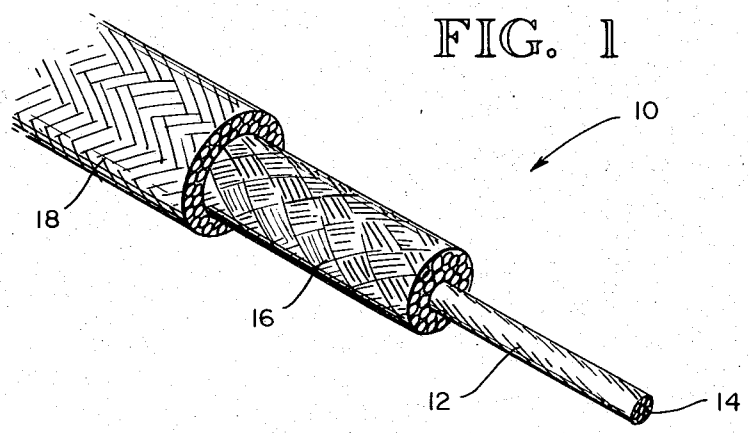
FIG. 1 is a perspective view partly broken away of one embodiment of this invention.
Figure 2:
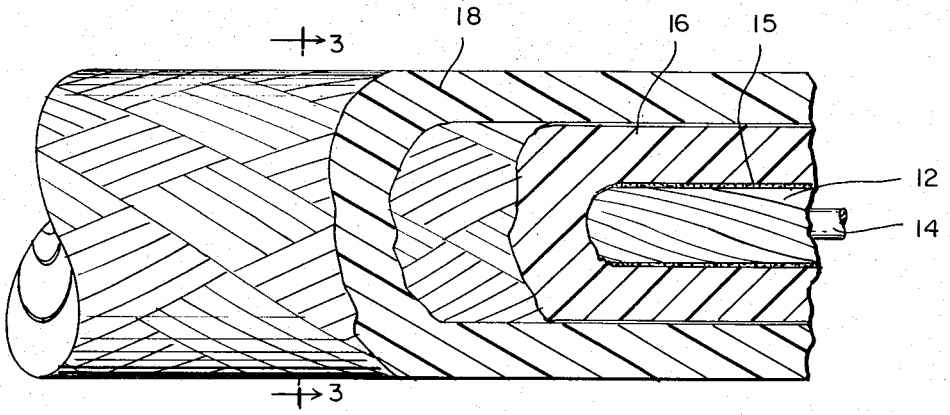
FIG. 2 is a side elevational view partly in section of the line shown in FIG. 1.

FIG. 1 shows a perspective view of the invention with portions thereof cut away for clarity. The core 12 is a multiple-strand cable made of a plurality of stainless steel strands surrounding its own core 14 of KEVLAR® aramid fiber. The exterior of the core 12 has been coated with an adhesive material 15, such as a rubber cement, which exhibits good adhesion to the exterior of the cable and to the interior of an inner primary sheath or sleeve 16 of the line 10.

The primary sheath 16 is comprised of a cylindrical braid of nylon filaments/fibers, such as sixty fibers braided in a standard, well-known, eight-carrier braid construction over the core 12. The core 12, treated with the adhesive material 15 on its exterior, is preferably passed upwardly through the center of the eight-carrier braiding apparatus whereupon the inner primary sheath 16 is tightly braided in direct contact with the exterior of the core 12. The adhesive material 15 causes the tightly braided primary sheath 16 to be securely adhered to the outer surface of the core 12. The primary sheath is preferably braided with four strands of nylon yarn in each carrier, with the braid thereof being formed in a conventional diamond braid.

To protect the inner primary sheath 16 from sunlight, to increase the overall diameter of the line 10, and to also increase the tensile strength of the line, one or more outer secondary sheaths or sleeves 18 are formed, much like the primary sheath, but using polyester fibers. The secondary sheath 18 may comprise, for example, a cylindrical braid of polyester fibers, such as sixty fibers braided in a standard eight-carrier braid construction over the inner primary sheath 16. The composite inner primary sheath 16 and core 12 is passed upwardly through the center of the eight-carrier braiding apparatus, whereupon the outer secondary sheath 18 is tightly braided over the outer surface of the primary sheath in a conventional diamond braid. The secondary sheath may be adhered, as by rubber cement, to the inner primary sheath. Of course, other well-known fibers and braid configurations may be used for the primary and secondary sheaths to alter the tensile strength and appearance of the resulting line.

By using the metallic central core 12, with the inner primary sheath 16 and one or more outer secondary sheaths 18 of fiber, the line 10 will not fail if exposed to the fire and heat or to sharp objects usually encountered by firemen, mountaineers and rescue workers. Should the primary and secondary sheaths 16 and 18 melt, burn or be severed, the metallic core 12 will remain intact, having been selected with sufficient weight-carrying strength to carry the rated load without complete failure of the line 10.

With this arrangement, the line 10 is highly resistant to fire, heat, chafing and severing, and also to chemicals and shock. The line need no longer be prematurely discarded just on the chance it has received sufficient exposure to cause failure during subsequent use, when in fact the line has not. With the line 10 of the present invention, the user may safely rely upon the inherent strength of the metallic core 12.

In a preferred embodiment of the invention, the inner primary sheath 16 is manufactured of nylon to achieve all the wall-recognized advantages of nylon. The outer secondary sheaths 18 are manufactured of a material other than nylon, such as polyester, which is not so susceptible to degradation when exposed to sunlight. In addition to adding to the thickness of the line 10 to facilitate its grasping by users, the outer secondary sheaths 18 shield the nylon inner primary sheath 16 and protect it from ultraviolet light, which in time would otherwise degrade the nylon. As such, the line 10 can be made using nylon and be exposed to sunlight without the disadvantage of light-induced degradation. The use of a polyester outer secondary sheath 18 also protects the less abrasion-resistant nylon inner primary sheath 16 from abrasion damage that would weaken the nylon.

Another advantage of the line 10 embodying the present invention is that it provides a static line. The metallic core 12 prevents any significant elongation of the line 10 during use, and avoids the bouncing or spring resulting therefrom even during extreme loading. This is achieved with the primary and secondary sheaths 16 and 18 providing a cover for the metallic core 10 which protects the user from directly grasping the metallic core, which can be too slippery or abrasive to handle. The line 10 is lightweight, and as a result of the sheaths 16 and 18, the line may be tied into knots which will cinch tightly enough to provide a safe hold. The line 10 can be easily and conveniently manipulated since it is not as unwieldly as cable.

Should the primary and secondary sheaths 16 and 18 burn or melt, or be severed at a point above where the load is applied to the line 10, the construction of the line will prevent the sheaths from slipping longitudinally along the core or relative to each other. In addition to the use of adhesive material 15 between the core 12 and the sheaths 16 and 18, and even when no adhesive is used, the diamond weave of the sheaths provides an interlock or Chinese-finger-trap effect when the sheaths break. As such, they tend to grip and hold onto the core or sheath within.

While the metallic core 12 is of a relatively high tensile strength, one of the important advantages of the line 10 of the present invention is achieved by selecting a core material with a tensile strength greater than the desired rated load-carrying ability for the line but substantially less than the overall tensile strength of the combined primary and secondary fibrous sheaths 16 and 18. As such, when the load limit of the metallic core 12 is exceeded and the core breaks, the core is entrapped and maintained within the still operative fibrous sheaths 16 and 18, and cannot snap back. In a manner, the sheaths provide a shock-absorber-like effect. This eliminates the danger of backlash to user and bystanders, and the sheaths 16 and 18 provide a load-carrying safety margin. The tensile strength of the sheaths 16 and 18 is selected to be sufficiently greater than that of the core 12 such that the tension on the two severed core portions will be completely relaxed before reaching the breaking strength of the sheaths under normal loading.

The construction of the line 10 further eliminates backlash of the fibrous sheaths 16 and 18 should they subsequently break. Since each of the severed portions of the line 10 will contain one of the previously severed metallic core portions, the backlash of the sheaths 16 and 18 is minimized by the dead weight of the untensioned core portions.

In one embodiment of the line 10, the selected core 12 was a 3/16-inch diameter non-rotating metal cable with a tensile strength of about 3,800 pounds. The sheaths 16 and 18 were selected with a combined tensile strength of about 6,000 pounds. The three examples set forth below provide the details for several ⅛-inch diameter cores. In all cases, the combined tensile strength of the sheaths 16 and 18 was about 6,000 pounds, having the same construction as the sheaths mentioned above with only the core size and type varied.

EXAMPLE 1

A rescue and safety line was manufactured for primary use as a fireman's safety rope. The rescue and safety line was manufactured using a ⅛-inch diameter stainless steel core with two layers of polymeric fiber sheaths braided about the core. The primary sheath was securely adhered to the core with rubber cement. The elements of the line had the following characteristics:

Core: ⅛-inch diameter, seven strands of 19 wires each being twisted with standard wire rope techniques. The wires were made of Type 304 stainless steel. The resulting cable, commonly known as "aircraft cable," had a breaking strength of 1,760 pounds per MIL-W-83420 or RR-W410.

Primary sheath: A synthetic sheath braided around and tightly adhered to the core and composed of Du-Pont Nylon, Type 707. The primary sheath was formed in a 16-carrier braiding apparatus with a 2×2 weave, using two strands per carrier of 8400 denier per strand with a 2.17 multiplier.

Secondary sheath: A synthetic sheath braided about the primary sheath and composed of Allied Chemical Corporation polyester 1W81. The secondary sheath was formed in a 16-carrier braiding apparatus with a 1×2 twill weave, using two strands per carrier of 10,00 denier per strand with a 5.48 multiplier.

The resulting line was relatively flexible and did not part when a 200-pound weight was suspended by the line and the sheath burned off with a propane torch. At the burned area, the sheath remained adhered to the core so that no axial movement between the core and the sheaths occurred.

EXAMPLE 2

The rescue and safety line with the construction of Example 1 was manufactured, but using a composite core of stainless steel fibers and KEVLAR® polyaramid fibers, manufactured according to the teachings of U.S. Pat. No. 4,034,547 and sold under the trademark K-FLEX®. The core was a ⅛-inch diameter (3.2 mm) cable having a rated breaking strength of 2,100 pounds. The primary sheath was adhered to the core with rubber cement to prevent bunching and axial movement along the rope. The resulting composite line had a nominal outer diameter of ½ inch.

EXAMPLE 3

A line similar in construction to Examples 1 and 2 was manufactured using a stainless steel core with a coil memory built in. This caused the line to assume a coiled configuration when not in tension. A ⅛-inch diameter coiled stainless steel cable was used and is sold by the Cable and Wire Rope Division of Loos and Co., Inc., Pomfret, Conn., under the trademark KO-BRAKOIL®. The resulting line was a self-coiling line ideally suited for boat bow lines, which would self-coil when tension was relieved.

In compliance with the statute, the invention has been described in language more or less specific as to structural features. It is to be understood, however, that the invention is not limited to the specific features shown. The means and construction herein disclosed comprise a preferred form of putting the invention into effect. The invention is therefore claimed in any of its forms or modifications within the legitimate and valid scope of the appended claims appropriately interpreted in accordance with the doctrine of equivalents.

I claim:

1. A composite line structure, comprising:

a core of a heat-resistant, substantially inelastic, metallic cable, having a tensile strength sufficient to separately support the desired rated load;

an inner nylon sheath braided or wrapped tightly about said core; and an outer polyester sheath braided or wrapped tightly about said inner sheath and shielding said inner sheath from exposure to sunlight or abrasion, said inner and outer sheaths having a combined tensile strength substantially exceeding the tensile strength of said core and containing said core therewithin upon breakage of said core under extreme loading to substantially eliminate backlash, said core having a weight sufficient to minimize backlash of said inner and outer sheaths upon subsequent breakage thereof, whereby a substantially static line is provided which will support the rated load even if said inner and outer sheaths are melted or severed by fire, heat or sharp objects, which substantially eliminates backlash, and which protects the nylon inner sheath from abrasion and sunlight.

2. The composite line structure of claim 1 wherein said inner sheath is securely adhered to said core to prevent its axial movement along said core.

3. The composite line structure of claim 2 wherein said inner and outer sheaths are adhered together.

4. The composite line structure of claim 1 wherein said sheath is braided around said core after said core has been coated with rubber cement.

5. The composite line structure of claim 1 wherein said core further includes high tensile strength polymer fibers.

6. The composite line structure of claim 1 wherein said core has an eleastic memory causing said line to assume a coiled configuration whenever tension on said line is relieved.

7. The composite line structure of claim 1 wherein said core is a non-rotating cable, whereby the line is non-rotating.

8. The composite line structure of claim 1 wherein said inner and outer sheaths have a diamond braid for gripping the sheath or core next within under loading.

9. The composite line structure of claim 1 further including one or more additional sheaths braided about said outer sheath to increase the diameter of the line to facilitate grasping and to increase the combined tensile strengths of the sheaths.

10. A composite line structure, comprising:

a core of a heat-resistant, substantially inelastic, metallic cable, having a tensile strength sufficient to separately support the desired rated load;

an inner sheath braided or wrapped tightly about said core; and an outer sheath braided or wrapped tightly about said inner sheath, said inner and outer sheaths having a combined tensile strength substantially exceeding the tensile strength of said core and containing said core therewithin upon breakage of said core under extreme loading to substantially eliminate backlash, said core having a weight sufficient to minimize backlash of said inner and outer sheaths upon subsequent breakage thereof, whereby a substantially static line is provided which will support the rated load even if said inner and outer sheaths are melted or severed by fire, heat or sharp objects, and which substantially eliminates backlash.

11. A composite line structure, comprising:

a core of a heat-resistant, substantially inelastic, metallic cable, having a tensile strength sufficient to separately support the desired rated load; and at least one sheath braided or wrapped tightly about said core, said at least one sheath having a tensile strength substantially exceeding the tensile strength of said core and containing said core therewithin upon breakage of said core under extreme loading to substantially eliminate backlash, said core having a weight sufficient to minimize backlash of said at least one sheath upon subsequent breakage thereof.

12. A composite line structure, comprising:

a core of a heat-resistant, substantially inelastic, metallic cable, having a tensile strength sufficient to separately support the desired rated load;

an inner sheath braided or wrapped tightly about said core; and an outer sheath braided or wrapped tightly about said inner sheath, said inner and outer sheaths having a combined tensile strength substantially exceeding the tensile strength of said core and containing said core therewithin upon breakage of said core under extreme loading to substantially eliminate backlash.

* * * * *